US011325007B2

(12) United States Patent
Rohner

(10) Patent No.: US 11,325,007 B2
(45) Date of Patent: May 10, 2022

(54) SWIMMING STROKE ALIGNMENT TOOL

(71) Applicant: Patricia Anne Rohner, Raleigh, NC (US)

(72) Inventor: Patricia Anne Rohner, Raleigh, NC (US)

(73) Assignee: Patricia A. Rohner, Raleigh, NC (US)

( * ) Notice: Subject to any disclaimer, the term of this patent is extended or adjusted under 35 U.S.C. 154(b) by 165 days.

(21) Appl. No.: 16/712,046

(22) Filed: Dec. 12, 2019

(65) Prior Publication Data

US 2021/0197028 A1 Jul. 1, 2021

(51) Int. Cl.
*A63B 31/12* (2006.01)
*A63B 31/10* (2006.01)
*A63B 31/00* (2006.01)

(52) U.S. Cl.
CPC ..... *A63B 31/10* (2013.01); *A63B 31/00* (2013.01); *A63B 31/12* (2013.01); *A63B 2225/09* (2013.01)

(58) Field of Classification Search
CPC ..... A63B 31/10; A63B 31/00; A63B 31/12; A63B 2225/09
See application file for complete search history.

(56) References Cited

U.S. PATENT DOCUMENTS

| | | | | |
|---|---|---|---|---|
| 3,789,447 | A * | 2/1974 | Lavallee | A63B 31/12 441/59 |
| 4,867,720 | A * | 9/1989 | Harrington | A63B 31/12 441/60 |
| 6,364,727 | B1 * | 4/2002 | Rangel | A63B 31/12 441/59 |
| 6,398,603 | B1 * | 6/2002 | Brown | A63B 31/12 441/59 |
| 9,849,339 | B1 * | 12/2017 | Stanley | A63B 31/12 |
| 10,137,331 | B1 * | 11/2018 | Al-Otaibi | A63B 31/10 |
| 10,258,831 | B1 * | 4/2019 | Vance | A63B 31/12 |
| 2008/0081525 | A1 * | 4/2008 | Dahl | A63B 31/10 441/56 |
| 2014/0187110 | A1 * | 7/2014 | Faidi | A63B 31/12 441/56 |
| 2016/0129313 | A1 * | 5/2016 | Aguiar | A63B 31/12 441/56 |

* cited by examiner

*Primary Examiner* — Stephen P Avila

(57) ABSTRACT

A training aid to correct arm position during the pulling phase of butterfly, backstroke, breaststroke, or crawl also referred to as freestyle, when swimming. The disclosed tool provides physical pressure to correct a common swimming error. Said tool prevents medial rotation of the glenohumeral joint of the shoulder rotator cuff during the catch and pull portion of swimming.

13 Claims, 4 Drawing Sheets

SWIMMING STROKE ALIGNMENT TOOL

CROSS-REFERENCE TO RELATED APPLICATION

Original Non-Provisional Application

BACKGROUND

Over the past few decades, the biomechanics of swimming has been continually moving towards optimizing the bodies movement through water. Much of the forward propulsion in the front crawl may be attributed to the arm stroke and, as such, has been a large focus of these studies.

The present invention relates to an aquatic article which is situated along the forearm for teaching proper swimming stroke mechanics.

SUMMARY OF THE INVENTION

As the understanding of the physics of swimming has improved the sport has changed the specific body positions used by swimmers. In recent years swimmers have begun to pull with fingertips pointing to the bottom, with a high elbow position.

This change in body position allows for a greater ability for the arm to push water backwards, helping making swimmers faster.

Many swimmers, both experienced and beginners, struggle with this high-elbow/fingertip-to-the-bottom arm position. It is natural to allow the elbow to lead the way in the pull rather than the hand. The present invention as an arm brace positioned along the forearm which provides negative reinforcement by pressing the tip of the brace uncomfortably into the bicep muscle when the swimmer allows the elbow to drop lower than the hand through lateral rotation of the glenohumeral joint from the rotator cuff muscles. As the amount of bend in the elbow joint increases the pressure placed on the bicep increases, stopping the incorrect range of motion. This pressure forces the swimmer to stop the incorrect motion.

In accordance with the embodiments of the invention, the tip of the brace will glide past the bicep applying no pressure when the shoulder rotates the elbow joint high through medial rotation of the glenohumeral joint from the rotator cuff muscles In accordance with the embodiments of the invention, the arm brace is light weight and rides close on the arm allowing for use over an extended time swimming. This extended wear allows the muscles to be retrained to remain in the correct arm position.

In accordance with the preferred embodiment of the invention the brace is created from lightweight yet rigid plastic material and may be held in place with two elastic straps, one at the elbow and one on the hand. The hand strap may alternatively be replaced by swimming paddles.

DETAILED DESCRIPTION OF THE INVENTION

The invention herein described is a unique concept of a brace to correct arm position during the pulling phase of butterfly, backstroke, breaststroke, or crawl also referred to as freestyle, when swimming. The disclosed arm brace provides physical pressure to correct a common swimming error. Said arm brace prevents medial rotation of the glenohumeral joint of the shoulder rotator cuff during the catch and pull portion of the swimming stroke.

Figure 1:
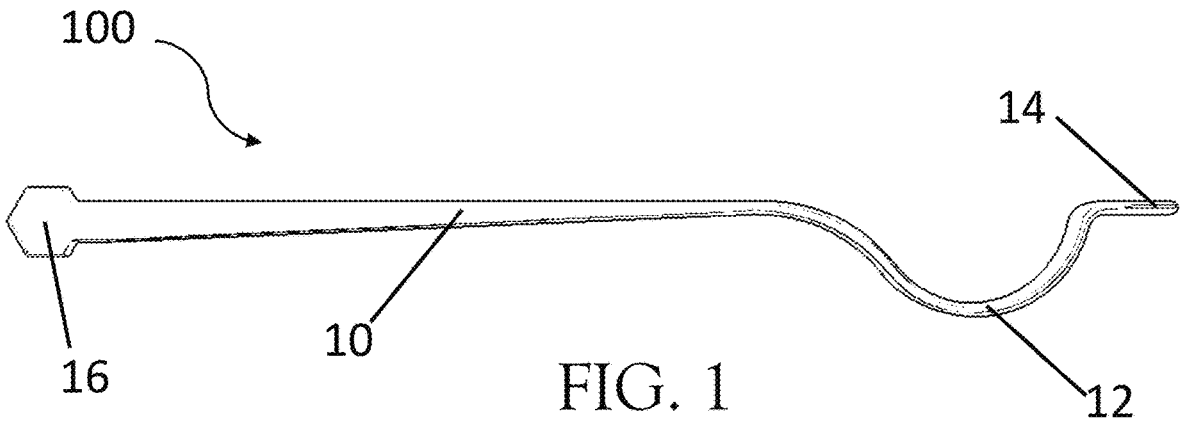
FIG. 1 shows a side view of the arm brace.
Figure 2:
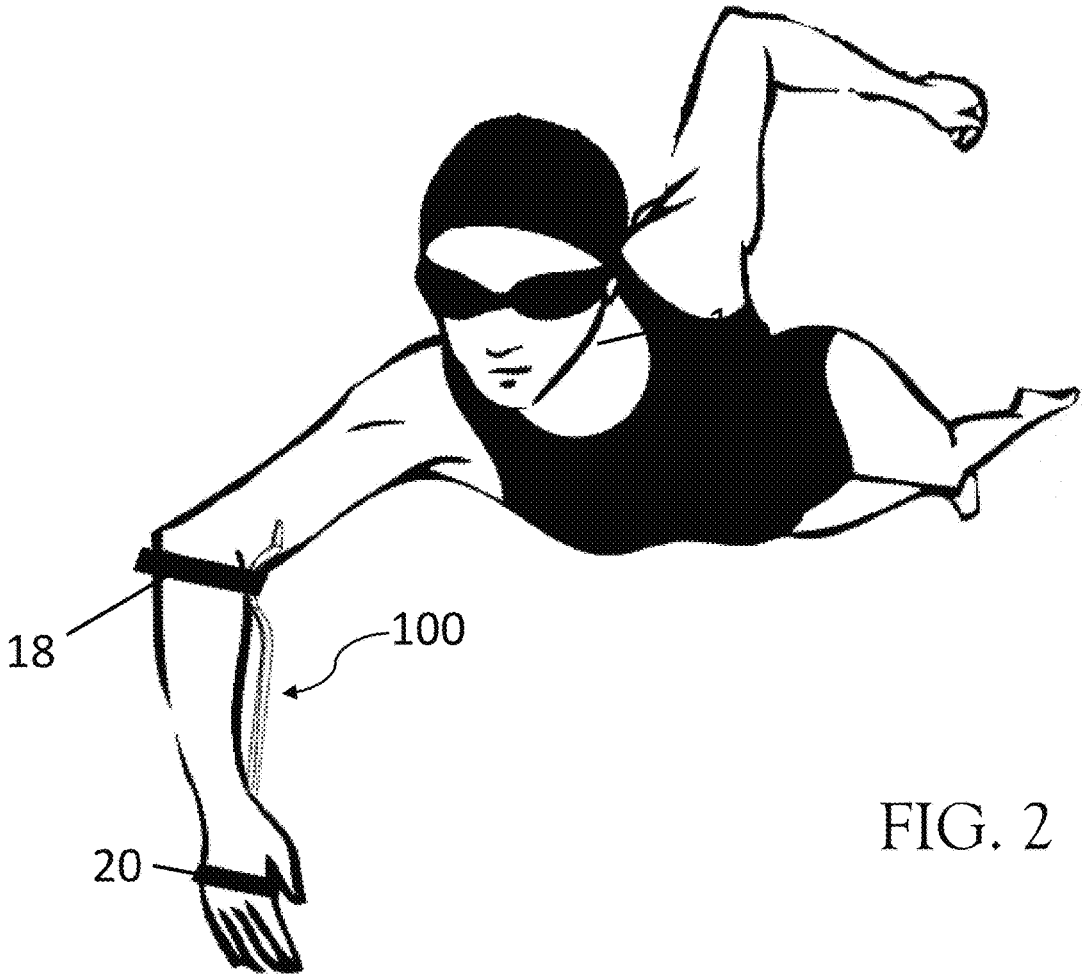
FIG. 2 shows the brace as it would fit on a person with correct arm placement.
Figure 5:
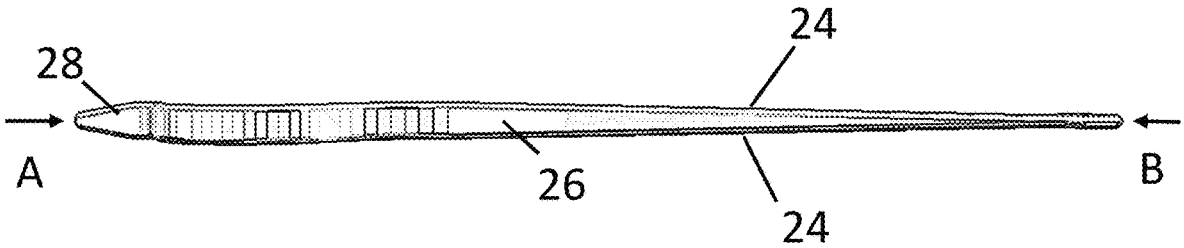
FIG. 5 shows an upper view of the brace with centerline to demonstrate symmetry.

FIG. 1 shows side or lateral view of the arm brace 100 and FIG. 2 illustrates how the device would be worn by a swimmer during training. In relation to the body of the swimmer shown in FIG. 2, the brace 100 has a proximal end which is secured at the cubital fossa and distal end which is secured at the palm. Furthermore, while FIG. 2 shows a brace 100 on the right arm of the swimmer, in the preferred embodiment, the tool would be symmetrical around the midline A-B illustrated in FIG. 5, allowing identical use on either arm.

In the preferred embodiment, the brace 100 is fabricated as a singular construction and formed by injection molded plastic. The material may be any variety of plastic, such as ABS, PET, HDPE, PVC, LDPE, or polypropylene. The preferred embodiment would have a generally neutral buoyancy in fresh water such that the swimmer's stroke is not affected by the weight of the material. A lightweight plastic such as polypropylene has a density of 0.92 grams per cubic centimeter and ABS may have a density of 1.05 grams per cubic centimeter—both of which provide an acceptable material for achieving neutral buoyancy as fresh water has a density of 1.0 grams per cubic centimeter. As an alternative method of construction, the brace may be constructed through additive manufacturing process or 3D printing. In this case, the data, program, or source file necessary for fabricating the brace may reside on a computer readable medium such as a disk drive, flash drive, or made available through a remote location on the internet.

As illustrated in FIG. 1, the arm brace 100 comprises several sections: the disk 16, the rod 10, the hook 12, and the point 14.

Figure 7:
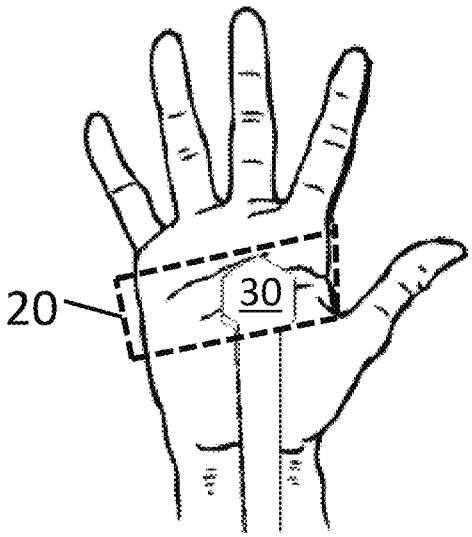
FIG. 7 shows the position of the distal end of the brace in relation to user's palm.

As shown in FIG. 7, the disk 16 is designed to rest against the palm of the swimmer's hand. The disk 16 is designed such that it fits within the palm of the swimmer's hand and therefore may increase or decrease in size to accommodate larger or smaller hands respectively. It should also be understood that while the element is referred to as a disk 16, the overall shape of the disk 16 may vary (i.e. circular, elliptical, polygon, or even a complex shape that conform to the swimmer's hand). In describing the size and planar orientation of the disk 16, the dimensions herein are given as that of the largest inscribed circle which may be positioned within the disk 16. In the preferred embodiment the disk 16 is 1 inch in diameter with its radius coplanar to the midline A-B shown in FIG. 5 and has two generally flat surfaces 30 on both sides of the disk 16. When the disk 16 is secured to the palm of the swimmer's hand, it provides: one of the two anchoring point for the brace 100; the benefit of keeping the wrist in-line with the forearm by inhibiting wrist flexion and extension; and enables the brace to rotate in a radial fashion as the forearm pronates or supinates.

In another embodiment, the radius of the disk 16 may be angled from the centerline AB of FIG. 7 to encourage a flexed or extended wrist position. In such an embodiment, the radius of the disk 16 may be up to 20 degrees from the centerline.

Figure 3:
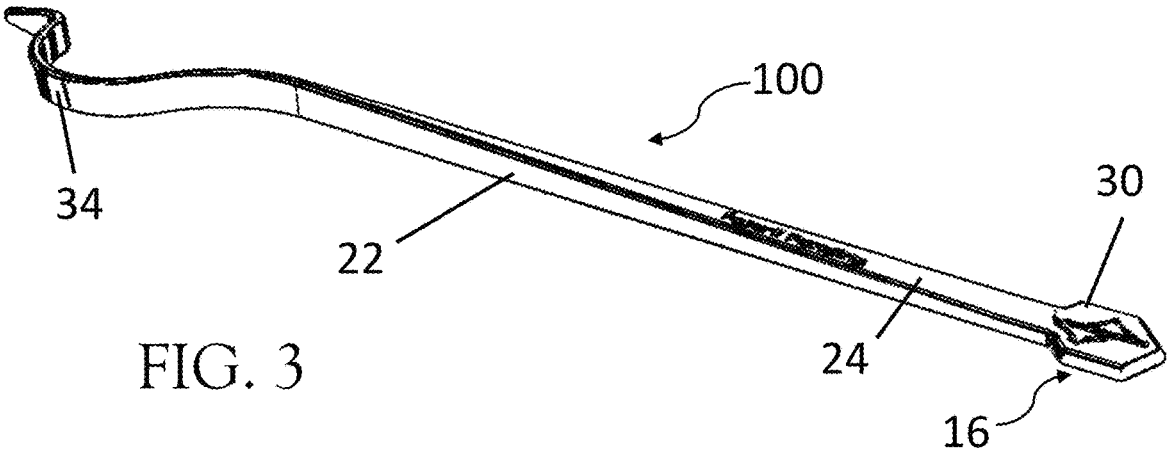
FIG. 3 shows a lower isometric view of the brace.

In yet another embodiment, the disk 16 may instead be spherical with a diameter ranging from 1.5 inches to 4.0 inches and preferably around 2.7 inches (similar to a tennis ball). In this embodiment, the swimmer places the sphere in their palm and curls their fingers around the sphere. In this scenario, the swimmer is required to place emphasis on the anterior of the forearm, rather than their hands, for propulsion through the water. The disk 16 is connected to the rod 10 as shown in FIG. 1. With regards to FIG. 3, in the preferred embodiment the traversal cross section of the rod 10 is rectangular with an upper wall 26 and lower wall 22 and two lateral side walls 24. In the preferred embodiment, the width of the upper wall 26 and lower wall 22 decreases moving from the hook 12 to the disk 16; and the height of the lateral side walls 24 increase moving from the hook 12 to the disk 16. Altering the wall shape in this way from the proximal to distal end of the rod provides strength as the hook and disk are generally perpendicular to one another. In addition, the increased surface area of the side wall 24 at the distal end of the rod 10 allows the brace 100 to conform with the correct position of the distal forearm and wrist of the swimmer prior to the disk 16 anchoring point. The lateral side walls 24 may taper into the flat area 30 of the disk 16.

Figure 4:
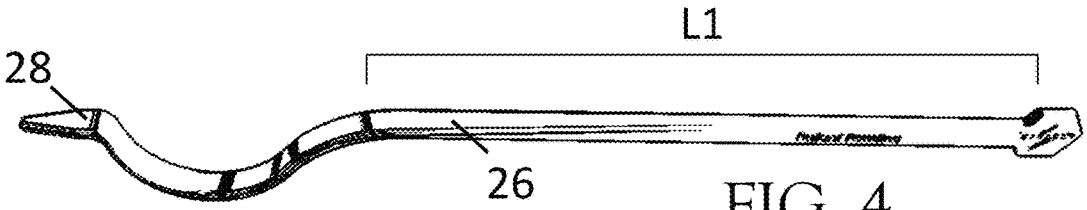
FIG. 4 shows an upper-side view of the brace.

The length of the rod 10 is indicated as L1 in FIG. 4 and this length generally corresponds to the inner forearm length (cubital fossa to wrist) of the swimmer and therefore may vary between 6 to 14 inches. In an alternative embodiment of the invention the rod 10 is either adjustable in length or replaceable with a rod 10 of a different length so that a single the body alignment arm brace 100 can be used by users of different heights. In the case of a replaceable rod 10, the ends of the rod 10 and the corresponding connecting point of the disk 16 and hook 12 may have a mating mechanism such as a screw and socket, or tapered rod and receiver. In an embodiment where the rod 10 is adjustable in length, the rod 10 may include a telescoping or concentric inner and outer rod with a length lock for holding the rod 10 to an adjusted length L1.

Figure 6:
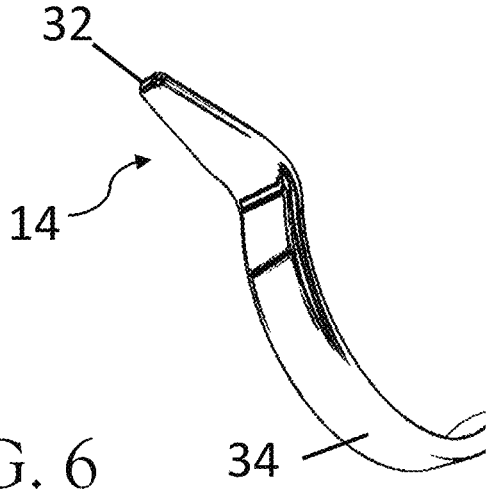
FIG. 6 shows a lower isometric view of the pressure point located at the proximal end of the brace.

The rod 10 transitions to the hook 12. In the preferred embodiment the hook 12 is a curved section generally configured as a half-ellipse, however, it should be understood that the elliptical arc angle of the hook 12 may vary from 135 degrees to 225 degrees. In the preferred embodiment, the upper wall 26, lower wall 22, and lateral walls 24 of the rod 10 extend and become the upper wall, lower wall 34, and lateral walls of the hook 12. The hook 12 lower wall 34 is shown in FIG. 6 and is configured to be positioned in contact with the pit of the elbow (also known as the cubital fossa), and this contact point is the second anchor point of the brace 100.

Figure 8:
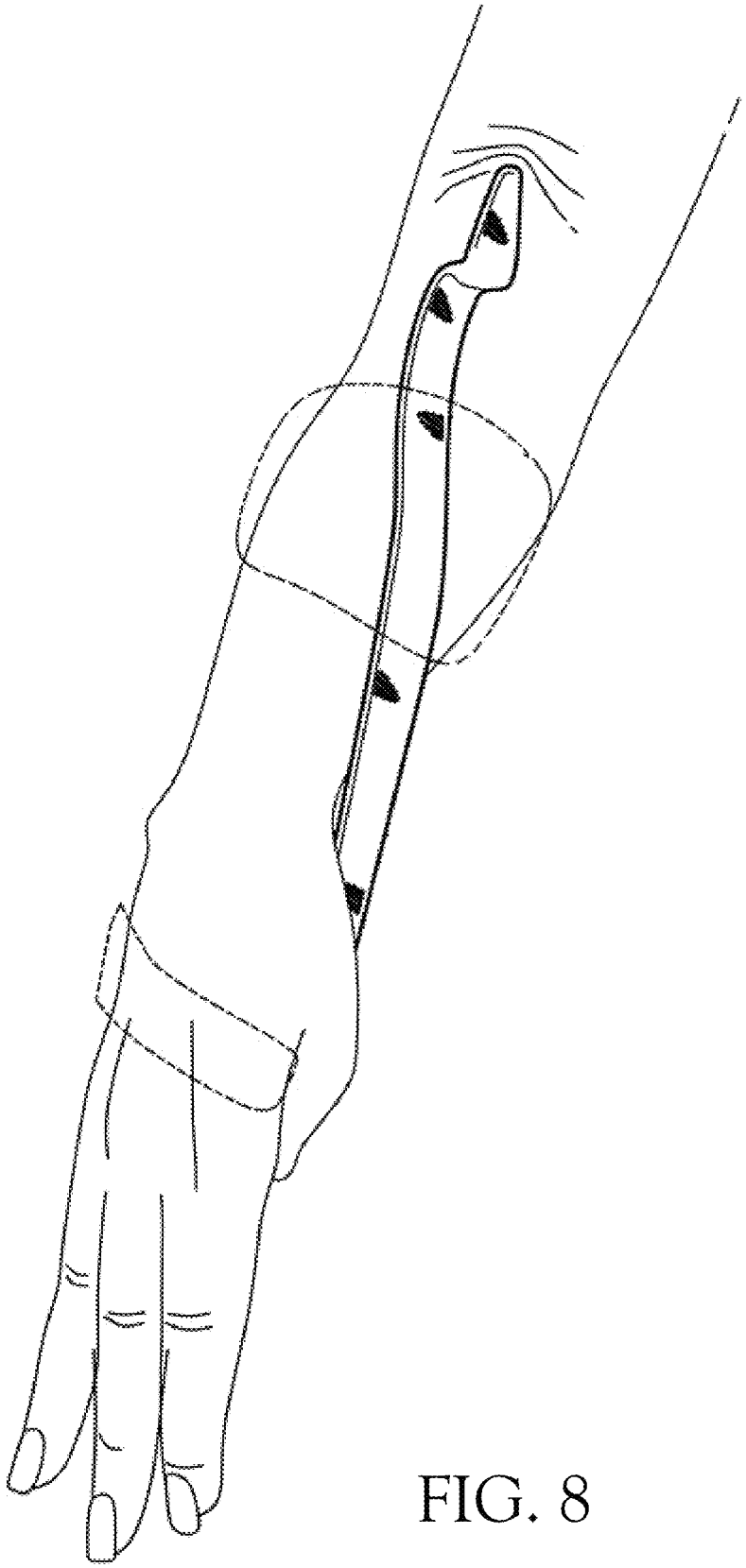
FIG. 8 shows the brace as it would fit on a person with incorrect arm placement.

At the proximal end of the hook 12 is the point 14 which is designed to press against the bicep, as shown in FIG. 8, of the swimmer performing an incorrect stroke when the elbow joint is allowed to drop to or near to the level of the hand. When the user swims with the arm in the incorrect position, the point 14, will press with increasing pressure as the person bends their elbow, preventing them from continuing in the range of motion.

When the stroke is performed correctly with the hand leading the elbow through the traversal plane of the swimmer, the point 14 will slide past the upper arm without making contact. In the preferred embodiment, the point 14 narrows to a semi-blunt tip 32 as shown in FIG. 6 such that it does not inflict damage to the swimmer. In the preferred embodiment, the upper wall of the tip 28 is parallel with the upper wall of the rod 26.

The brace 100 may be secured to the swimmer at two locations: the intersection of the lower wall of the hook 34 and the cubital fossa, and at the intersection of the swimmer's palm and the disk. At these points, the brace may be secured by means of a proximal strap 18 and a distal strap 20. The preferred straps are elastic bands with hook and loop closure mechanisms. Persons skilled in the art will recognize that many variations of details and materials are possible. In an alternative embodiment, the brace 100 may be secured to the palm by placing the disk 16 between the palm and a swim paddle secured to the hand.

METHOD OF USE

A method of using the swimming stroke alignment tool while swimming which includes attaching a brace 100 to a swimmer's forearm comprising an elongated member or rod 10 with a proximal hooked section secured to the cubital fossa with an integrated tip 14, and a second attachment point at the distal end of the rod in contact with the swimmer's palm. The hook 12 of the brace 100 positioned such that the tip 14 of the rod 10 presses into the bicep of the swimmer when the elbow leads the hand through the traversal plane, thus training the swimmer to maintain proper, high elbow arm alignment while swimming.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A swim training apparatus to be worn by a swimmer to maintain correct arm position while swimming comprising: an elongated rod, a disk, a hook, and a point;

wherein the elongated rod has a length defined by its centerline and a vertical plane passing through said centerline;

wherein said disk is located at the distal end of said rod in a vertical orientation;

wherein said hook begins at the proximal end of said rod and comprises an initially downward curved extension of said rod, an arc which is formed by the curved extension, and an ending point which lies on the vertical plane of the rod;

wherein said point is positioned at the end of the hook and has a tip which is oriented away from the rod.

2. The swim training apparatus of claim 1, wherein the disk is secured to the swimmer's palm, and the hook has an exterior surface along the outside body of the arc which is secured to the swimmer's cubital fossa.

3. The swim training apparatus of claim 2, wherein the tip is configured to press into the swimmer's bicep muscle when the swimmer's elbow leads the hand in caudal direction due to the lateral rotation of the glenohumeral joint from the rotator cuff muscles.

4. The swim training apparatus of claim 2, wherein an elastic strap with a hook-and-loop closure mechanism is used to secure said hook to said cubital fossa.

5. The swim training apparatus of claim 4, wherein an elastic strap with a closure mechanism is used to secure said disk to the palm.

6. The swim training apparatus of claim 1, wherein the apparatus consists of a homogeneous plastic body.

7. The swim training apparatus of claim 6, wherein the apparatus has a density between 0.92 and 1.07 grams per cubic centimeter.

8. The swim training apparatus of claim 1, wherein the disk comprises a sphere with a radius between 1.5 inches and 3.0 inches.

9. The swim training apparatus of claim 8, wherein the disk comprises a sphere with a radius of 2.7 inches.

10. The swim training apparatus of claim 1, wherein the point is a rectangular pyramid arrangement with a base that is perpendicular to the length of the rod.

11. The swim training apparatus of claim 1, wherein the elongated rod is straight and with no more than 15 degrees of flexion and extends from mid palm to just above the elbow with curve sitting in the elbow joint.

12. A computer-readable medium for creating a three-dimensional model of a swim training apparatus comprising:

a computer readable medium and a data file;

wherein the data file contains computer readable instructions enabling replication of said swim training apparatus;

and wherein said swim training apparatus comprises an elongated rod, a disk, a half-elliptical hook, and a point;

wherein the disk is positioned at the proximal end of the elongated rod and the hook is an extension of the elongated rod and where the curve begins at the distal end of the elongated rod;

wherein the point is attached at the end of the hook and has a tip.

13. The method of swimming comprising:

attaching a swim training apparatus to an arm; wherein the swim training apparatus comprises an elongated rod, a disk, a hook and a point;

wherein the elongated rod has a length defined by its centerline and a vertical plane passing through said centerline;

wherein said disk is located at the distal end of said rod in a vertical orientation and secured to the swimmer's palm by means of a strap;

wherein said hook begins at the proximal end of said rod and comprises an initially downward curved extension of said rod, an arc which is formed by the curved extension, and an ending point which lies on the vertical plane of the rod, and is secured to the swimmer's cubital fossa by means of a strap; and wherein said point is positioned at the end of the hook and has a tip which is oriented away from the rod.

* * * * *